United States Patent [19]

Nishio et al.

[11] Patent Number: 4,596,639

[45] Date of Patent: Jun. 24, 1986

[54] ELECTROLYSIS PROCESS AND ELECTROLYTIC CELL

[75] Inventors: Tsutomu Nishio; Yasushi Samejima, both of Kakogawa; Minoru Shiga, Himeji; Toshiji Kano, Kakogawa; Koji Saiki, Toyonaka, all of Japan

[73] Assignee: Kanegafuchi Kagaku Kogyo Kabushiki Kaisha, Osaka, Japan

[21] Appl. No.: 434,737

[22] Filed: Oct. 18, 1982

[30] Foreign Application Priority Data

| | | | |
|---|---|---|---|
| Oct. 22, 1981 | [JP] | Japan | 56-169753 |
| Jul. 27, 1982 | [JP] | Japan | 57-131377 |
| Sep. 13, 1982 | [JP] | Japan | 57-160433 |

[51] Int. Cl.[4] ..... C25B 1/16

[52] U.S. Cl. ..... 204/98; 204/128; 204/257; 204/251; 204/263; 204/266

[58] Field of Search ..... 204/251, 266, 98, 237, 204/263

[56] References Cited

U.S. PATENT DOCUMENTS

| | | | |
|---|---|---|---|
| 3,677,926 | 7/1972 | Davis | 204/251 |
| 3,728,234 | 4/1973 | Sakzi et al. | 204/237 |
| 3,893,897 | 7/1975 | Raetzch et al. | 204/98 |
| 3,901,774 | 8/1975 | Motani et al. | 204/98 |
| 3,923,614 | 12/1975 | De Nora et al. | 204/99 |
| 4,036,714 | 7/1977 | Spitzer | 204/251 |
| 4,065,367 | 12/1977 | de Nora | 204/98 |
| 4,101,407 | 7/1978 | Hilaire et al. | 204/251 |

OTHER PUBLICATIONS

"New Design of Brine Electrolyser with a Membrane and a Mercury Cathode", Hermana et al., Journal of Applied Electrochem., 9(1979) 758–763.

*Primary Examiner*—John F. Niebling
*Assistant Examiner*—Terryence Chapman
*Attorney, Agent, or Firm*—Armstrong, Nikaido, Marmelstein & Kubovcik

[57] ABSTRACT

Disclosed is an electrolysis process which is characterized by carrying out the electrolysis of an aqueous alkali metal halide solution while supplying a cathode liquor into a cathode compartment formed between a cation exchange membrane positioned substantially horizontal and a cathode plate of gas-liquid impermeability, with which the membrane is wetted, then a mixed stream of the cathode liquor and cathode gas being removed from the cathode compartment.

Also disclosed is an electrolytic cell which is comprised of an upper anode compartment and a lower cathode compartment partitioned by a cation exchange membrane positioned substantially horizontal, said anode compartment having therein substantially horizontal anodes and an anolyte solution inlet and outlet, and said cathode compartment having a cathode plate with gas-liquid impermeability and a cathode liquor inlet and an outlet of a mixed stream of the cathode liquor and cathode gas.

13 Claims, 14 Drawing Figures

ELECTROLYSIS PROCESS AND ELECTROLYTIC CELL

BACKGROUND OF THE INVENTION

1. Field of the Invention

The present invention generally relates to an electrolysis process and electrolytic cell for electrolysis of an aqueous alkali metal halide solution, especially an aqueous alkali metal chloride solution. More particularly, it relates to a process and apparatus for mainly obtaining a high purity caustic alkali more effectively with a low electrolytic voltage using a horizontal type electrolytic cell providing a cation exchange membrane as an electrolytic separator.

2. Description of Prior Art

The horizontal type electrolytic cell is partitioned by a separator positioned horizontal into an upper anode compartment and a lower cathode compartment and has been in considerably widespread use industrially.

The most typical horizontal electrolytic cell is a mercury electrolytic cell but destined to be shut down in the near future since mercury served as a cathode contaminates environment. When such a mercury cathode electrolytic cell is desired to be converted into a separator electrolytic cell employing no mercury with a reduced cost, the separator electrolytic cell should be of a horizontal type. In view of the situation, it is a significant matter the industry is now encountering to develop a process for producing a high purity product, not inferior to a product by the mercury process, with a high current efficiency using such horizontal type separator electrolytic cells.

A process for remodeling a mercury cell to a horizontal type separator cell is revealed in the U.S. Pat. No. 3,923,614. In the process, however, a porous membrane (diaphragm) is used to serve as a separator, having great water permeability and accordingly anolyte solution passes through the separator hydraulically to thus mingle in, for example, caustic alkali produced in the cathode compartment, thereby resulting in decreased purity.

On the other hand, a cation exchange membrane called a non-porous membrane permits no passage of anolyte solution or catholyte liquor hydraulically, allowing only water molecules coordination-bonded to alkali metal ions transported electrically to pass, hence a high purity caustic alkali being obtained. To the contrary, a small quantity of water transported evaporates to cause electric conduction failure between a membrane and a cathode, in the long run to terminate electrolytic reaction.

The U.S. Pat. No. 3,901,774 proposes processes to solve these problems; one is a process for placing a liquid maintaining material between a cation exchange membrane and a cathode and another discloses a process for carrying out the electrolysis while supplying to a cathode an aqueous caustic alkali liquor in mist or spray.

Notwithstanding, the former process not only involves the problems including troubles for interposing the liquid maintaining material and the durability thereof, but increases electrolytic voltage because the distance between electrodes is expanded by the liquid maintaining material located between the cation exchange membrane and the cathode, besides an increase in resistance of the liquid maintaining material per se. Hence it can not be an advantageous process. Moreover the latter process has some difficulty in practice on an industrial scale since the uniform supply of liquid is difficult when applied to a large-scale electrolytic cell such as employed commercially.

The present invention has been completed in order to eliminate the deficiencies attendant on the conventional processes as aforesaid and enables the conversion of a mercury cell into a horizontal type cation exchange membrane cell with a relative ease, at the same time, achieving the production of a high purity caustic alkali with a high current efficiency. The present invention is, of course, useful in newly constructing a cell with new materials.

SUMMARY OF THE INVENTION

An object of the present invention is to obtain a high purity caustic alkali with high efficiency using a horizontal type separator electrolytic cell.

Another object of the present invention is to provide an improved horizontal type separator electrolytic cell with high performance providing a cathode of a new structure.

A further object of the present invention is to provide a horizontal type separator electrolytic cell with high performance, a horizontal type cation exchange membrane electrolytic cell, in particular, made by remodeling a mercury electrolytic cell.

Other objects of the present invention will be made apparent from the following description.

The foregoing objects can be achieved by an electrolysis process of the present invention that in an electrolysis process of an aqueous alkali metal halide solution using a horizontal type electrolytic cell provided with an anode compartment located on a cation exchange membrane positioned substantially horizontal and a cathode compartment under said membrane, it is characterized in that a gas-liquid impermeable cathode plate is placed in close proximity to or in contact with the cation exchange membrane, a cathode liquor stream is formed which flows in a space of the cathode compartment formed between the cation exchange membrane and the cathode plate, while the lower side of the membrane being wetted with the cathode liquor stream, a caustic alkali and hydrogen gas is enfolded in the cathode liquor stream immediately when prepared in the space of the cathode compartment and then removed from the cathode compartment.

An electrolytic cell suitably used for practicing the process of the present invention which is characterized by;

an anode compartment and a cathode compartment partitioned by a cation exchange membrane positioned substantially horizontal, said anode compartment having therein substantially horizontal anodes and being surrounded by a top cover, side walls positioned so as to enclose the anodes and the upper side of the membrane, and provided with an inlet and an outlet of anolyte solution and an outlet of anode gas, said cathode compartment being surrounded by a cathode plate having gas-liquid impermeability, side walls so as to enclose the cathode plate and the lower side of the membrane, and provided with an inlet of cathode liquor and an outlet of a mixed stream of the cathode gas and the cathode liquor.

DETAILED DESCRIPTION OF THE INVENTION

Figure 1:
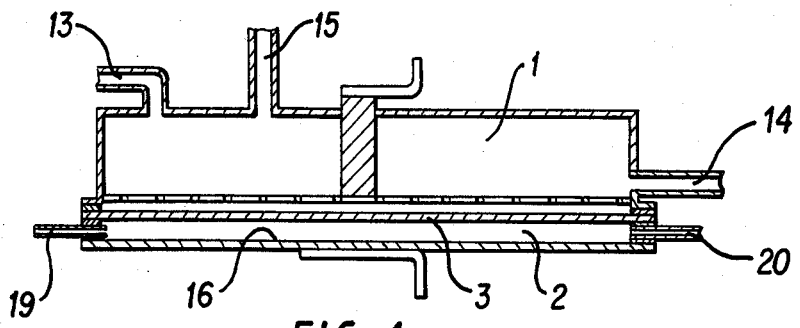
FIG. 1 is a vertical front sectional view illustrating an embodiment of the present invention.

Hereinafter, embodiments of the present invention will be explained in detail by referring to the drawings attached. The following explanation is referred, for convenience sake, to sodium chloride which is most popular in the industry and typical of alkali metal halides, and to caustic soda as an electrolytic product, but to which the present invention is not limited, the present invention being, needlessly, applied to the electrolysis of an aqueous solution of other inorganic salts, water and the like.

In FIG. 1 there is illustrated an embodiment of an electrolytic cell of the present invention.

The cell is partitioned by a cation exchange membrane 3 into an anode compartment 1 on the cation exchange membrane 3 and a cathode compartment 2 under the membrane 3, wherein a cathode plate 16 is gas-liquid impermeable and forms, by itself, a part of walls (bottom wall) of the cathode compartment. The anode compartment 1 is provided with an anode solution inlet 13 and outlet 14 and an anode gas outlet 15 and the cathode compartment 2 is provided with a cathode liquor inlet 19 and an outlet 20 of a cathode mixed stream of cathode liquor and cathode gas.

Figure 2:
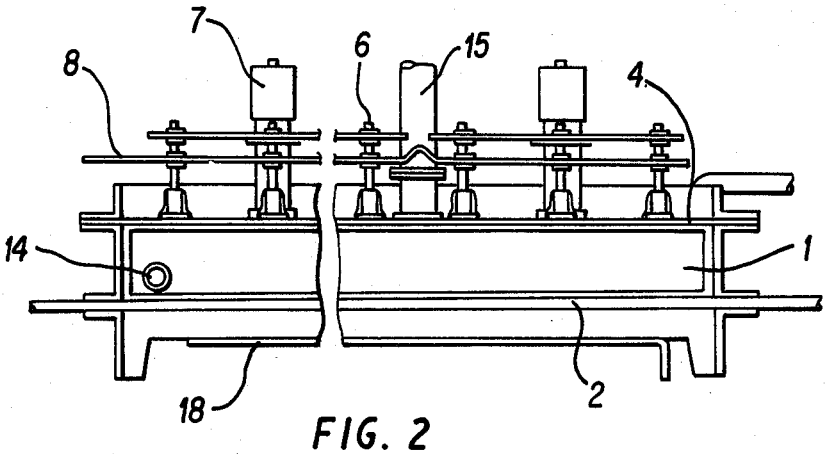
FIG. 2 to FIG. 4 are a front view, a vertical front sectional view and a vertical side sectional view, respectively, showing an embodiment of the present invention.
Figure 3:
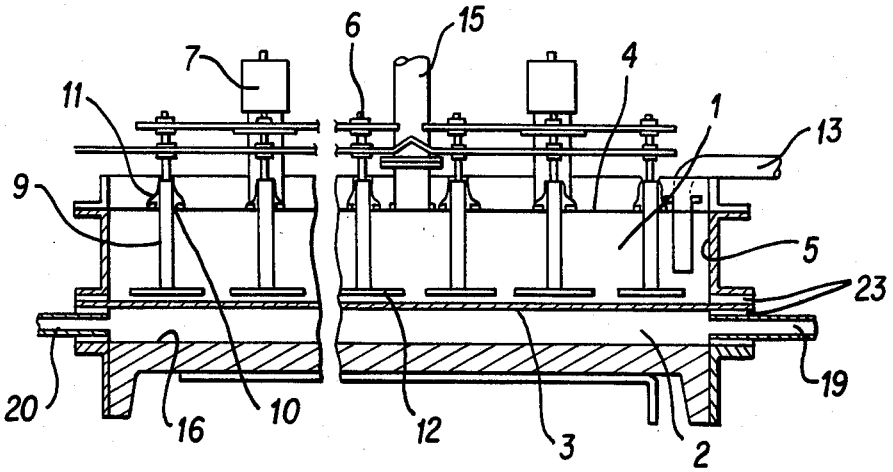
Figure 4:
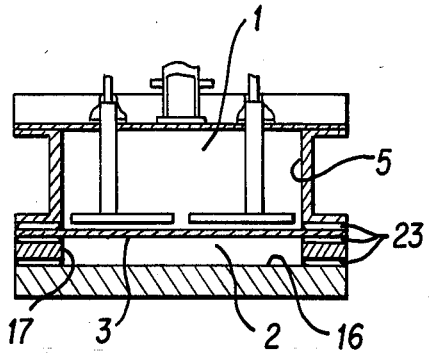

FIG. 2 to FIG. 4 are a front view, a vertical front sectional view and a vertical side sectional view, respectively, of an electrolytic cell of the present invention.

In FIG. 2 and FIG. 3, an apparatus of the present invention is comprised of an anode compartment 1 and a cathode compartment 2 located thereunder, both compartments being of a rectangular shape having the greater length than the width, preferably several times the length. The anode compartment 1 and the cathode compartment 2 are separated from each other by a cation exchange membrane 3 positioned substantially horizontal between side walls of the compartments. The word "substantially horizontal" also includes the cases where the membrane is positioned slightly slant (up to a slope of about 1/10).

The cation exchange membrane used suitably in the present invention includes, for example, membranes made of perfluorocarbon polymers having cation exchange groups. The membrane made of a perfluorocarbon polymer containing sulfonic acid groups as a cation exchange group is sold by E. I. Du Pont de Nemours & Company under the trade mark "NAFION", having the following chemical structure;

$$\left(CF-CF_2\right)_m\left(CF_2-CF_2\right)_n$$
$$\left(O-CF_2-\underset{\underset{CF_3}{|}}{CF}\right)_l O-CF_2-CF_2-SO_3H$$

The equivalent weight of such cation exchange membranes is preferred in a range between 1,000 and 2,000, more preferably in a range between 1,100 and 1,500. The equivalent weight herein means weight (g) of a dry membrane per equivalent of an exchange group. Moreover membranes whose sulfonic acid groups are substituted, partly or wholly, by carboxylic acid groups and other membranes widely used can also be applied to the present invention. These cation exchange membranes exhibit very small water permeability so that they permit the passage of only sodium ion containing three to four molecules of water, while hindering the passage of hydraulic flow.

The anode compartment 1 is formed by being surrounded by a top cover 4, side walls 5 of the anode compartment located so as to enclose anodes 6 suspended from the top cover 4 and the upper side of a cation exchange membrane 3. The anodes 6 are suspended by anode-suspending devices 7 located on the top cover 4 and are connected to one another by an anode busbar 8. The top cover 4 possesses holes 10 through which anode conducting rods 9 are inserted and the holes 10 are sealed airtight by sheets 11. To the lower ends of the anode conducting rods 9, are anode plates 12 secured. As such, the anode plates 12 are connected to the anode-suspending devices 7, so that those can ascend and descend by the adjustment of the anode-suspending devices 7, thereby being positioned so as to come into contact with the cation exchange membrane 3. Of course, the anodes may also be suspended by other means, not being limited to the cases where those are suspended from the anode-suspending devices positioned to the top cover. For instance, the anodes may be suspended by being secured to an anode compartment frame which is fabricated of the top cover and the side walls, united in one body, as depicted in FIG. 1. Moreover, the anode compartment is provided with at least one anolyte solution inlet 13, which may be positioned to the top cover 4 or side walls 5 of the anode compartment. On the other hand, at least one anolyte solution outlet 14 is provided and may be positioned to the side walls 5. Furthermore, to a suitable place of the top cover 4 or the side walls 5, an anode gas (chlorine gas) outlet 15 is provided.

As the material for the top cover 4 and side walls 5 forming the anode compartment 1, a top cover and side walls of an anode compartment of a mercury electrolytic cell may also be diverted and any chlorine-resistant material may be effectively used. Examples of such materials are chlorine-resistant metals such as titanium and an alloy thereof, fluorocarbon polymers, hard rubbers and the like. Moreover iron lined with the foregoing metals, fluorocarbon polymers, hard rubbers and the like may also be employed.

As the anode plate 12 on which the anode reaction takes place, a graphite anode may also be used, but an insoluble anode made of metals such as titanium and tantalum coated with platinum group metals, platinum oxide group metals or mixtures thereof is preferred to use. Of course, anode plates used in a mercury electrolytic cell may be directly diverted without altering dimensions and shapes. With a view to rapidly removing gas generated to an upper portion, a porous electrode such as an expanded metal sheet, a net-like or louver-like electrode, a spaghetti-like electrode and the like may also be used.

Figure 5:
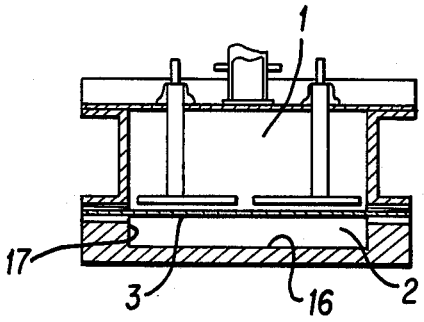
FIG. 5 and FIG. 6 are vertical side sectional views illustrating other embodiments of the cathode compartment.
Figure 6:
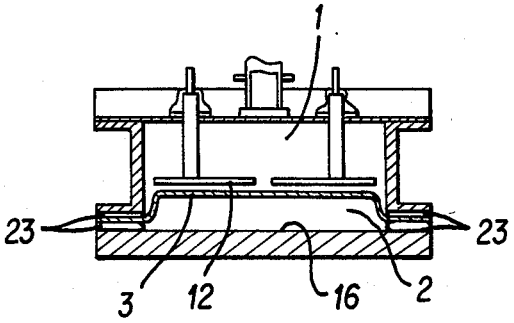

The cathode compartment 2, on the other hand, is formed by being surrounded by the lower side of the cation exchange membrane 3, a cathode plate 16 and side walls 17 of the cathode compartment positioned so as to enclose the cathode plate along the periphery of the cathode plate. The side walls 17 of the cathode compartment may be made of those such as frames having some rigidity or may also be made of those such as packings of rubbers, plastics and the like. Furthermore, as depicted in FIG. 5, the portion of the bottom plate opposing the anodes through the cation exchange membrane is shaved off except the periphery and the remaining bank-like periphery of the cathode plate is served as the side walls of the cathode compartment. In rebuilding a mercury electrolytic cell, the periphery of the bottom plate opposite to a lower flange of the side walls of the anode compartment is remained in such a manner as aforesaid and served as the side walls of the cathode compartment, which is one of preferable embodiments. Moreover the structure shown in FIG. 6 provides preferable side walls. That is, a thin layer packing 23 is placed on the periphery of the cathode plate 16, the anode plates 12 are located upper than the lower flange of side walls forming the anode compartment and the cation exchange membrane 3 is located along the inside surfaces of the side walls of the anode compartment utilizing the flexibility of the membrane to thus form the cathode compartment.

As the material for the side walls 17 of the cathode compartment, any material resistant to caustic alkali such as sodium hydroxide may be used including, for example, iron, stainless steel, nickel and an alloy thereof. Iron base material lined with alkali-resistant materials may also be suitably used. Moreover materials such as rubbers and plastics may also be used. As those materials, there are exemplified rubbers such as natural rubber, butyl rubber and ethylenepropylene rubber (EPR), fluorocarbon polymers such as polytetrafluoroethylene, copolymers of tetrafluoroethylene and hexafluoropropylene and copolymers of ethylenetetrafluoroethylene, polyvinyl chloride and reinforced plastics.

The cathode plate 16 used in the present invention possesses the gas-liquid impermeability. One of preferable embodiments is a cathode plate having a substantially flat surface and it may form, by itself, a part of walls (bottom wall) of the cathode compartment. The word "substantially flat surface" herein means such a degree that flowing of mixed stream of cathode liquor and cathode gas might not be prevented or hindered, and thus requiring no specific flattening by mechanical processing and the like. A cathode plate used in a mercury electrolytic cell may directly be diverted. The cathode plate 10 may be made of electroconductive materials such as iron, nickel and stainless steel. Moreover those materials, the surfaces of which were subjected to plasma flame spray with nickel or silver, or plated with a nickel alloy to reduce hydrogen overvoltage may be used.

Figure 10:
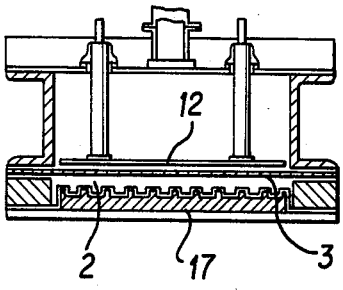
FIG. 10 is a vertical side sectional view of an electrolytic cell provided with a cathode plate of a concave-convex structure.

As shown in FIG. 10, a cathode plate 10, the surface of which is of a concave-convex structure, a preferred embodiment. The concaveness may be in any form such as a U-shape or a V-shape and should preferably be provided over the full width of the cathode plate 16 and stretch along the full length of the cathode plate 16. The concave-convex structrure may be given by shaving off a flat plate to thus form ditches in parallel to one another, welding a plurality of thin rods such as round rods and square rods to flat plate or by uniting protuberances and a flat plate. Moreover the cathode plate may be made of a corrugated plate. The corrugation may be in any form such as rectangular, trapezoidal, sinusoidal or cycloidal shape. The concave-convex structure need not necessarily be continuous to a longitudinal way and may be intermittent for the purpose. To obtain the preferable linear velocity as stated later, it is easy to design the ditch having a desired cross section area. The cathode liquor may be supplied under pressure but the whole of the cell is preferably slanted so that the cathode plate slopes to give a suitable fall to a flowing direction of the cathode liquor, in order to avoid back pressere imposed on the cation exchange membrane.

Moreover, in the event that the convexities necessarily caused by the formation of the concave ditches are too large in width, not only the removal of hydrogen gas becomes difficult when placed to be in contact with the cation exchange membrane, but, it happens in some extreme cases that the cation exchange membrane is not wetted with the cathode liquor stream. Inversely, in cases where the width is too small, there rise problems including an increase in the electrolytical voltage due to an increase of the current density.

Thus, care must be taken to choose a suitable value according to the electrolysis conditions and the structure of cells. Anyhow, it is most preferable that the concave ditches are uniformly provided over the entirety of the cathode plate and that the whole lower surface of the cation exchange membrane is wetted with the cathode liquor flowing in the concave ditches substantially to every corner of the membrane.

In the present invention the cathode plate is preferably positioned in such a way that the convexities are in contact with or in close proximity, keeping a small distance of about 1 mm or less, to the lower side of the cation exchange membrane.

Next, an inlet of cathode liquor and an outlet of a mixed stream of cathode gas and cathode liquor may be provided so that a flow of the mixed stream of cathode gas and cathode liquor can be formed in the cathode compartment 2 surrounded by the cation exchange membrane 3, side walls 17 of the cathode compartment and the cathode plate 16. Accordingly, those may be positioned at a suitable place of the cathode plate 16 or the side walls 17 of the cathode compartment. The sectional structure of the cathode liquor inlet is not limited in particular, but sufficient provided that it allows a flow of cathode liquor to occur, as aforesaid. The cathode liquor should desirably flow uniformly and for this purpose an inlet in a slit shape is a preferred embodiment. The mixed stream may be flowed to a longitudinal direction of the cell or a vertical direction thereto.

Figure 7:
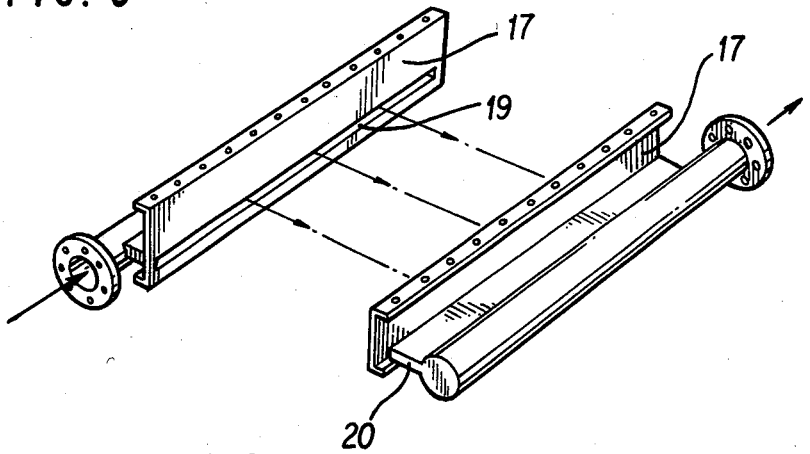
FIG. 7 to FIG. 9 are perspective views depicting embodiments of an inlet or an outlet of cathode liquor.

In FIG. 7 there is shown an embodiment where an inlet and an outlet of cathode liquor are provided to side walls of the cathode compartment. To one portion of the side walls 17 of the cathode compartment, the cathode liquor inlet 19 in a slit shape is provided and to the other portion of the side walls opposing the inlet 19, the outlet 20 of the mixed stream is provided, whereby cathode liquor is uniformly introduced through the inlet 19 into the cathode compartment and the mixed stream is collected and then discharged through outlet 20.

Figure 8:
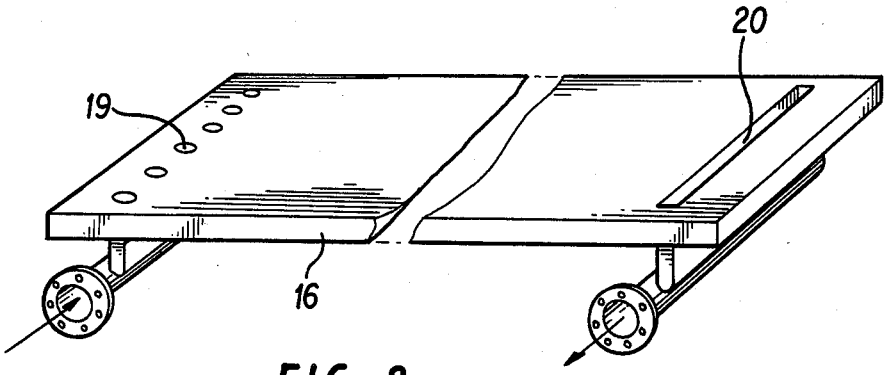
Figure 9:
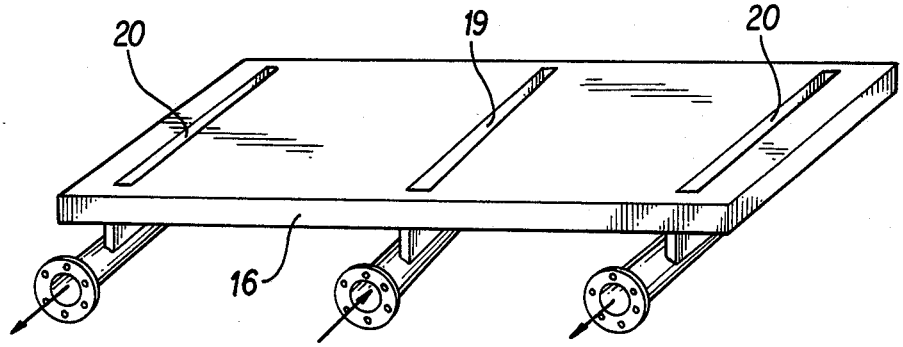

Depicted in FIG. 8 and FIG. 9 are embodiments where an inlet is provided to the cathode plate. In FIG. 8 an inlet 19 comprising a plurality of holes is provided to one end of the cathode plate 16 and an outlet 20 is provided to the other end of the cathode plate opposing the inlet 19. FIG. 9 shows an example in which an inlet 19 is provided to a central portion of the cathode plate 16 and outlets 20 are provided to both ends of the cathode plate. The relation in position between an inlet and an outlet of cathode liquor is not specifically limited but preferred to be such that those are provided in positions opposing each other.

Figure 11:
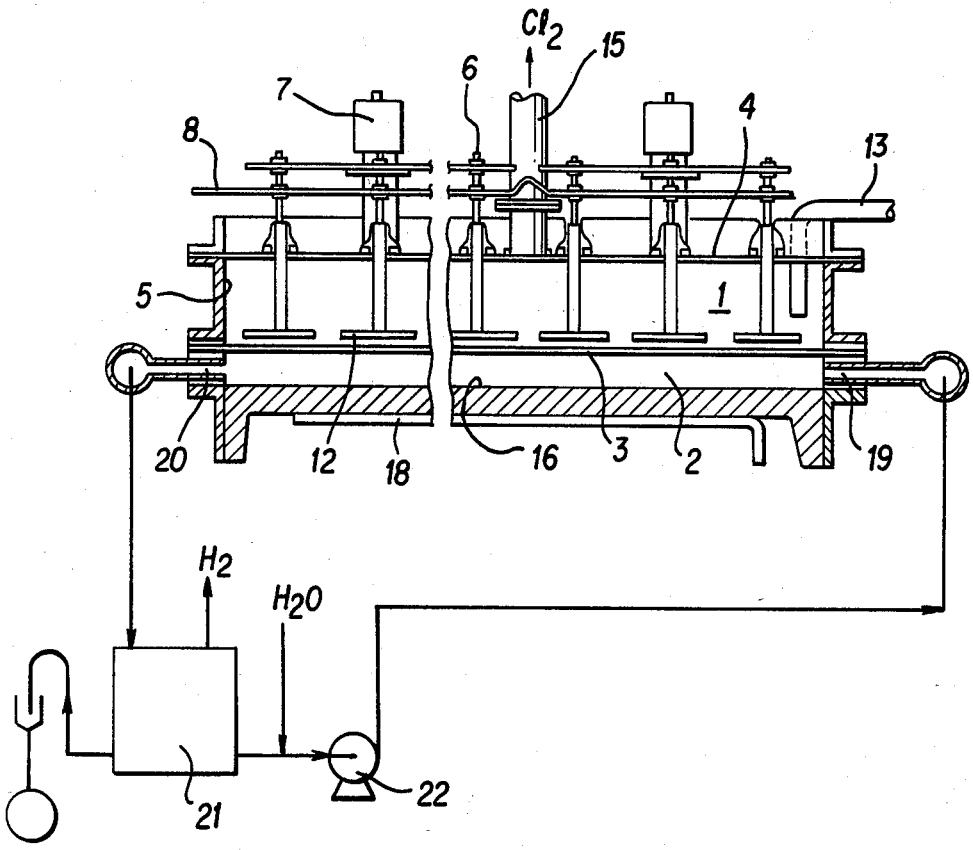
FIG. 11 is a vertical front sectional view of a horizontal type cation exchange membrane electrolytic cell made by remodeling a mercury electrolytic cell, involving a schematic representation of the circulating system of cathode liquor.

FIG. 11 is a vertical front sectional view of a horizontal type cation exchange membrane electrolytic cell made by remodeling a mercury electrolytic cell according to the present invention, including a schematic representation of the circulating system of cathode liquor.

In the figure, an anode compartment 1 is formed by being surrounded by a top cover 4, side walls 5 of the anode compartment provided so as to enclose a plurality of anodes 6 and anode plates 12 suspended from the top cover and the upper side of a cation exchange membrane 3 positioned by being sandwiched in between the lower flange of anode compartment side walls 5 and cathode compartment side walls (not shown). The anodes 6 are suspended vertically by anode-suspending devices 7 located protruding at the top cover 4 and connected to each other by a busbar 8. The anode compartment 1 is provided with an anode solution inlet 13, an anode solution outlet and an anode gas outlet 15.

On the other hand, a cathode compartment 2 is formed by being surrounded by a cathode plate 16, directly diverted to from a bottom plate of a mercury electrolytic cell, having a substantially flat surface, cathode compartment side walls positioned at the periphery of the cathode plate 16 and the lower side of the cation exchange membrane 3. The cathode plate 16 is connected to a cathode busbar 18. The cathode compartment 2 is provided with a cathode liquor inlet 19 and an outlet 20 of a mixed stream of cathode liquor and cathode gas.

A saturated brine is supplied through the anode solution inlet 13 into the anode compartment 1 and then electrolysed therein. Chlorine gas generated is removed through the anode gas outlet 15 and depleted brine is discharged through the anode solution outlet.

The cathode liquor is supplied through the cathode liquor inlet 19 into the cathode compartment 2 and mixed with hydrogen gas evolved in the cathode compartment to provide a mixed stream, discharged through the outlet 20 of the mixed stream, then the mixed stream being transported to a separator 21 in which hydrogen gas is separated from liquor. The cathode liquor containing substantially no hydrogen gas is recirculated by use of a pump 22 through the cathode liquor inlet 19 to the cathode compartment 2. The separator 21 and the pump 22 may be one, respectively, for a plurality of cells, otherwise, for each cell.

The electric current is supplied to an anode busbar 8, passed through the bottom plate 16 of the cathode compartment 2 and then taken out from a cathode busbar lB.

In the anode compartment 1, the following reaction takes place;

$$Cl^- \xrightarrow{-e} \tfrac{1}{2} Cl_2$$

Sodium ions in the anode compartment 1 move through the cation exchange membrane 3 to the cathode compartment 2. In the cathode compartment 2, on the other hand, the following reaction occurs;

$$H_2O \xrightarrow{+e} \tfrac{1}{2} H_2 + OH^-$$

In the cathode compartment sodium hydroxide is produced by reaction of hydroxyl ions with sodium ions transported through the cation exchange membrane 3 from the anode compartment 1, concurrently with evolution of hydrogen gas.

In the electrolysis using the cation exchange membrane, a vertical type cell is commonly employed. In this case, hydrogen gas generated in the cathode compartment is rapidly removed behind the cathode (i.e., to an apposite direction to the cation exchange membrane), and hence a porous cathode fabricated of expanded metal sheets, perforated metal sheets, metal nets and the like with a view to reducing the resistance of the cathode liquor may be used.

Nonetheless, in the case of a horizontal type cell it is impossible to remove hydrogen gas with a small specific gravity behind the cathode, i.e., under the cathode located extending to a horizontal way.

Therefore, the greatest feature of the present invention lies in that into the cathode compartment comprised of the lower side of the cation exchange membrane 3 and the cathode plate 16 with gas-liquid impermeability positioned adjacent thereto, cathode liquor is supplied and the cathode compartment is filled therewith to thus form a mixed stream of cathode liquor and cathode gas, with which the lower side of the cation exchange membrane 3 is wetted to allow the electrolysis reaction to take place smoothly, at the same time, sodium hydroxide and hydrogen gas produced in a space between the cation exchange membrane 3 and the cathode plate 16 are enfolded in the stream, then discharged outside the cathode compartment 2.

It is advantageous to recirculate back to the cathode liquor inlet 19 at least a part of the cathode liquor which is supplied into the cathode compartment, removed together with hydrogen gas and caustic soda produced and then separated from hydrogen gas by the separater 21, since the concentration of caustic soda can be increased optionally and adjusted by being diluted with water.

As stated above, it is exceedingly important in the present invention how effectively sodium hydroxide and hydrogen gas produced in the space of the cathode compartment are removed from the cathode compartment by being enfolded in the flowing of the cathode liquor.

Figure 12:
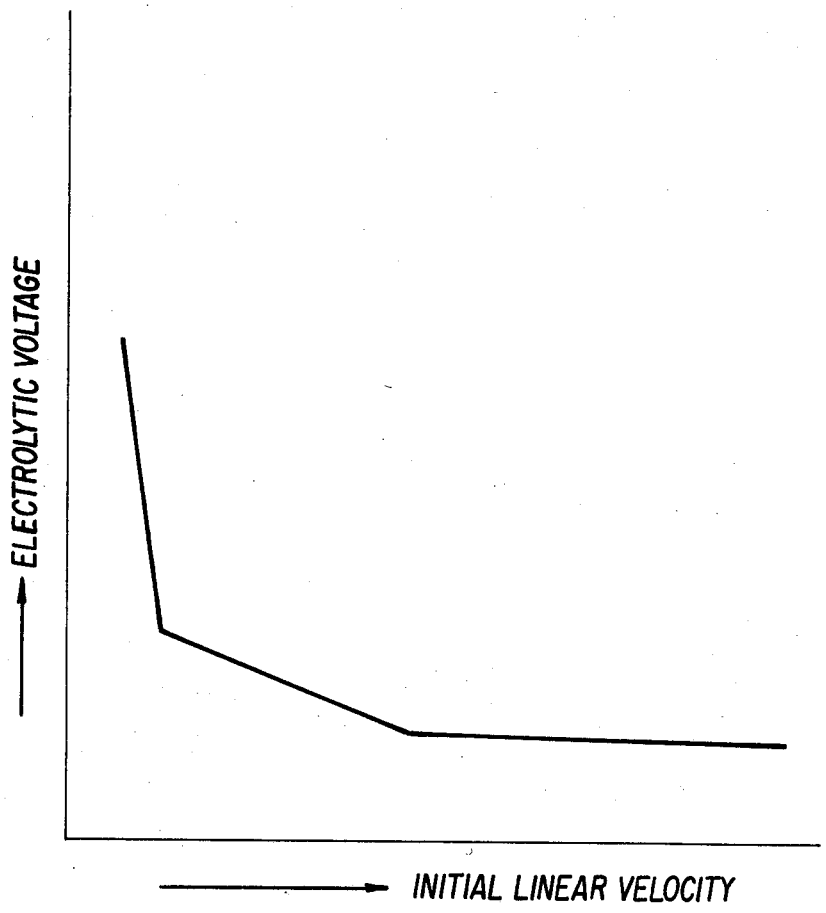
FIG. 12 is a graph showing the relative relation between the initial linear velocity and the electrolytic voltage.

The present inventors have made an extensive study on the relation between the initial linear velocity in the cathode compartment of cathode liquor supplied and the electrolytic voltage. FIG. 12 is a graph showing the relative relation between the initial linear velocity of the cathode liquor and the electrolytic velocity.

The initial linear velocity hereby means the following. That is, the cathode liquor supplied into the cathode compartment entrains gas evolved by the electrolysis while flowing in the cathode compartment so that the velocity generally increases as approaching to the outlet. Hence, the linear velocity of the cathode liquor containing no gas in the neighborhood of the cathode liquor inlet or containing a small amount of gas, if any, is called the initial linear velocity.

As is apparent from FIG. 12, the voltage decreases abruptly with an increase in an amount of the cathode liquor supplied, then decreases gradually, thereafter arrives at the steady state approximately. It has been made clear by the present inventors that bending points of the curve as seen in FIG. 12 have almost no connection with the current density and appear at approximately the same amount of flow in a range between about 5 $A/dm^2$ and about 100 $A/dm^2$. The abrupt decrease of voltage up to the first bending point is supposed to take place because of a rapid reduction in the residence of gas under the lower surface of the cation exchange membrane with an increase in the flow rate. The slow decrease of voltage from the first bending point to the second bending point is probably caused by a decreased deposition of gas onto the surfaces of the electrode and the cation exchange membrane with an increase in the amount of flow. The foregoing bending points shift to the side of high linear velocity as the distance from the cathode liquor inlet to the outlet becomes long.

According to the results of study made by the present inventors, the first bending point appears at the initial linear velocity of about 8 cm/sec or more, and the second bending point appears at about 20 cm or more. Those are values under the conditions that the current density is in a range of from about 5 to 100 $A/dm^2$ and that the length of the cell is in a range of from about 0.5 to about 20 m.

Therefore, in obtaining a high purity caustic alkali with a high efficiency at a low electrolytic voltage in accordance with the process of the present invention it is necessary to operate maintaining the initial linear velocity of the cathode liquor supplied into the cathode compartment placed under the cation exchange membrane positioned substantially horizontal at about 8 cm/sec or more, more preferably about 20 cm/sec or more.

Hereinbelow are experimental examples for more concrete explanation, to which the present invention is not construed to be limited.

EXPERIMENTS 1-6

As a cation exchange membrane, "NAFLON 901 (Registered trademark, manufactured and sold by E. I. Du Pont de Nemours & Company)" was positioned horizontal over an iron cathode plate whose surface was subjected to plasma flame spray with nickel, 70 cm in length and 10 cm in width.

The cathode plate has ditches, 5 mm in depth and 5 mm in width, running parallel to the longitudinal direction at intervals of 10 mm and situated so as to bring convexities into contact with the cation exchange membrane. As the anode, a titanium expanded metal whose surface is coated with $RuO_2$ and $TiO_2$ was employed and positioned to be in contact with the membrane. The anode compartment was controlled to keep the NaCl concentration at 3.5 N and the cathode compartment was controlled to keep the caustic soda concentration at 32%. The temperature was adjusted to 80° C. ±1° C.

Figure 13:
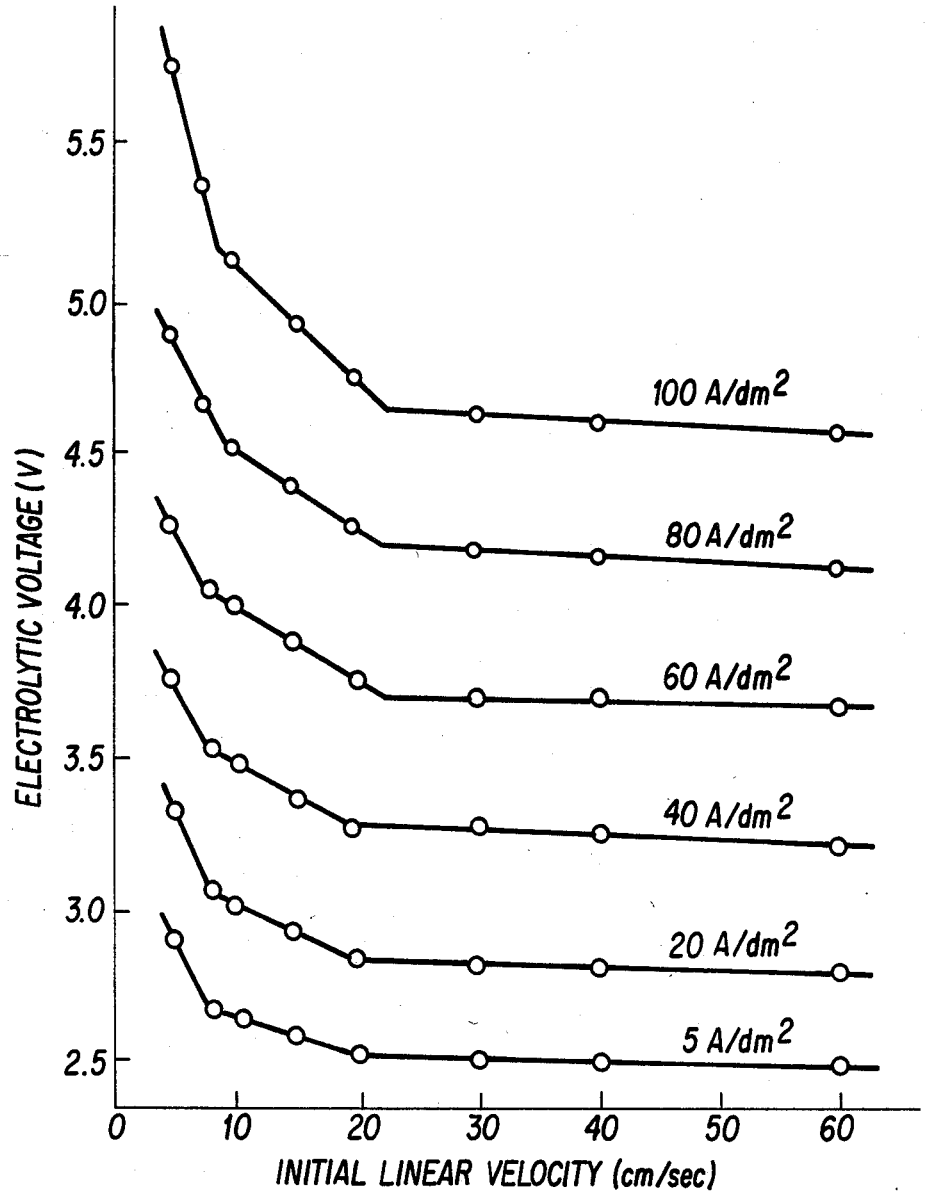
FIG. 13 is a graph depicting the relation among the current density, the initial linear velocity and the electrolytic voltage.

The electrolytic voltage to the initial linear velocity was plotted in FIG. 13 at the current densities of 5 $A/dm^2$, 20 $A/dm^2$, 40 $A/dm^2$, 60 $A/dm^2$, 80 $A/dm^2$ and 100 $A/dm^2$, respectively.

EXPERIMENTS 7-11

Figure 14:
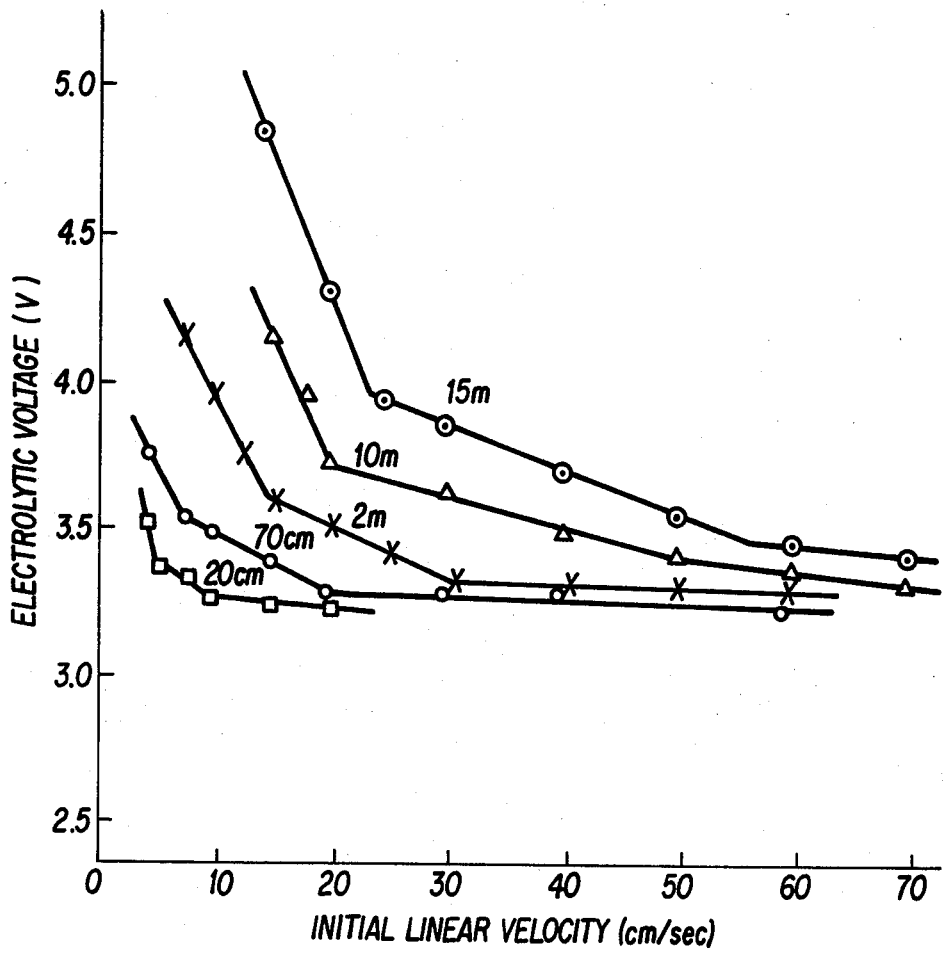
FIG. 14 is a graph exhibiting the relation among the length of an electrolytic cell, the initial linear velocity and the electrolytic voltage.

Experiments were performed under the same conditions as in Examples 1~6, except that the length of the electrolytic cell was changed to 0.2 m, 0.7 m, 2 m, 10 m and 15 m, respectively The electrolytic voltage to the initial linear velocity at the current density of 40 $A/dm^2$ was shown in FIG. 14.

As was mentioned above, the present invention is capable of producing a high purity caustic alkali at a low voltage with a high efficiency by the use of a horizontal type electrolytic cell which is provided with a cation exchange membrane and a substantially gas-liquid impermeable cathode plate. Moreover the electrolytic cell of the present invention can be manufactured by remodeling a mercury electrolytic cell and thus almost all existing equipments including busbars, rectifiers, disposal equipments of depleted brine and brine system equipments as well as electrolytic cells can be diverted without being scrapped, with a result that mercury electrolytic cells are converted economically and advantageously into cation exchange membrane electrolytic cells.

What we claim is:

1. In an electrolysis process of electrolyzing an aqueous alkali metal halide solution using a horizontal type electrolytic cell provided with an anode compartment located on a cation exchange membrane positioned substantially horizontal and a cathode compartment under said membrane, the improvement which comprises the steps of:

providing a cathode plate having gas-liquid impermeability in close proximity to or in contact with the cation exchange membrane flowing a cathode liquor stream in a space of the cathode compartment formed between the cation exchange membrane and the cathode plate, with which the lower side of the membrane is wetted, and enfolding a caustic alkali and hydrogen gas, immediately when formed in the space of the cathode compartment, in the cathode liquor stream to thereby remove the caustic alkali and hydrogen gas from the cathode compartment.

2. The electrolysis process of claim 1, wherein at least a part of the cathode liquor which is removed from the cathode compartment and separated from the hydrogen gas is recirculated back to serve as the cathode liquor flowing in the space of the cathode compartment.

3. The electrolysis process of claim 1 or claim 2, wherein the initial linear velocity of the cathode liquor flowing in the space of the cathode compartment is 8 cm/sec or more.

4. The electrolysis process of claim 3, wherein the initial linear velocity of the cathode liquor flowing in the space of the cathode compartment is 20 cm/sec or more.

5. The electrolysis process of claim 1 or claim 2, wherein the cathode plate has a substantially flat surface.

6. The electrolysis process of claim 1 or claim 2, wherein the cathode plate has a concave-convex surface to a flowing direction of the cathode liquor.

7. An electrolytic cell for electrolysis of an aqueous alkali metal halide solution, comprising an upper anode compartment and a lower cathode compartment partitioned by a cation exchange membrane positioned substantially horizontal in the cell, the anode compartment having therein substantially horizontal anodes and being surrounded by a top cover, side walls positioned so as to enclose the anodes and an upper side of the membrane, and being provided with an inlet means for supplying anolyte solution and separate outlet means for removing anolyte solution and anode gas, the cathode compartment being provided with a cathode plate, side walls so as to enclose the cathode plate and an underside of the membrane, and an inlet means for supplying cathode liquor and an outlet means for removing a mixed stream of cathode gas and cathode liquor, wherein the cell is retrofitted from a mercury electrolytic cell, the cathode plate is gas-liquid impermeable and forms the bottom wall of the cathode compartment; and the outlet for removing a mixed stream of the cathode compartment is connected with the inlet means for supplying cathode liquor of the cathode compartment by recirculating means comprising piping, a gas separator and a pump for recirculating cathode liquor to the inlet means of the cathode compartment after separation from the cathode gas.

8. The electrolytic cell of claim 7, wherein the cathode plate has a substantially flat surface.

9. The electrolytic cell of claim 7, wherein the cathode plate has parallel protuberances in a flowing direction of the cathode liquor.

10. The electrolytic cell of claim 7, claim 8 or claim 9 wherein the cathode compartment of the cell is provided by positioning the cation exchange membrane on the periphery of a bottom plate of a mercury electrolytic cell, with a packing interposed therebetween; and thus is surrounded by the bottom plate, inside surface of the packing and the cation exchange membrane within the cathode compartment.

11. The electrolytic cell of claim 7, wherein the cathode compartment of the cell is provided by shaving off a bottom plate of the mercury electrolytic cell except at its periphery opposite to a lower flange of side walls of the anode compartment of the mercury electrolytic cell, to thereby providing a space between the bottom plate and the membrane.

12. The electrolytic cell of claim 7, wherein:

the cathode compartment is formed by positioning side walls of the cathode compartment on the periphery of a bottom plate of the mercury electrolytic cell and by providing the inlet means for supplying cathode liquor on one portion of the side walls or one end of the bottom plate and the outlet means for removing a mixed stream of cathode gas and cathode liquor on another portion of the side walls or another end of the bottom plate, the cation exchange membrane is positioned substantially horizontal on the side walls of the cathode compartment, and the anode compartment is formed by positioning side walls of the anode compartment of the mercury electrolytic cell on an upper surface of the membrane, and by providing anodes over the membrane, the inlet means for supplying anolyte or the outlet means for removing anolyte solution and the outlet means for removing anode gas.

13. The electrolytic cell of claim 7, wherein the means for supplying cathode liquor includes means for supplying cathode liquor at 8 cm/sec or more.

* * * * *